United States Patent [19]

Renfro et al.

[11] 4,447,186

[45] May 8, 1984

[54] AIRCRAFT LOADING ADAPTER FOR USE WITH ORDNANCE LIFT VEHICLE

[75] Inventors: Vernon E. Renfro, Somis; Ronald L. Gudgeon, Ventura; John P. Clelland, Redondo Beach; Clyde C. Cole, Ventura, all of Calif.

[73] Assignee: The United States of America as represented by the Secretary of the Navy, Washington, D.C.

[21] Appl. No.: 363,349

[22] Filed: Mar. 29, 1982

[51] Int. Cl.[3] ..... B66F 9/14

[52] U.S. Cl. ..... 414/589; 414/607; 414/685; 414/718

[58] Field of Search ..... 414/607, 589, 590, 749, 414/685, 718

[56] References Cited

U.S. PATENT DOCUMENTS

| | | | |
|---|---|---|---|
| 2,867,334 | 1/1959 | Aiken et al. | 414/589 |
| 2,931,519 | 4/1960 | Beach | 414/589 |
| 3,038,614 | 6/1962 | Morley et al. | 414/590 |
| 3,067,884 | 12/1962 | Williams | 414/589 X |
| 3,087,630 | 4/1963 | Karnow et al. | 414/590 |
| 3,409,158 | 11/1968 | Lull | 414/590 X |
| 3,524,556 | 8/1970 | Miller | 414/589 |
| 3,606,952 | 9/1971 | Mankey | 414/607 X |

OTHER PUBLICATIONS

Brochure, Little Giant Attachments, Item 14, 1/1975.

*Primary Examiner*—Robert J. Spar
*Assistant Examiner*—Terrance L. Siemens
*Attorney, Agent, or Firm*—Robert F. Beers; Joseph M. St. Amand

[57] ABSTRACT

An adapter for use with lift forks or the like of a lift truck to allow very accurate positioning of ordnance and the like for attachment to aircraft. The adapter comprises a base which is supported or secured to the lift forks and includes an ordnance load carrying cradle carried on a trolley mechanism that allows degrees of freedom in the fore/aft and lateral directions.

10 Claims, 5 Drawing Figures

AIRCRAFT LOADING ADAPTER FOR USE WITH ORDNANCE LIFT VEHICLE

BACKGROUND OF THE INVENTION

This invention relates to ordnance loading systems and more particularly to an adapter for use with the lift boom or lift forks on a weapon loader lift truck to provide additional fore or aft and lateral movements of the ordnance load for very accurate positioning of an ordnance load relative to an aircraft to facilitate the loading or unloading of the same.

Equipment to position ordnance for attachment to aircraft wings and the like have generally been limited in the degrees of freedom of motion provided and in ease for imparting several degrees of freedom. Various systems have been devised to further position a load once a vehicle, such as lift truck or a dolly, has horizontally and vertically positioned the load in the general area for attachment to an aircraft, for example. The lift boom (e.g., fork-lift) or dolly is usually limited to vertical (raising or lowering) movement plus any horizontal movement imparted by moving the entire vehicle and cannot readily or accurately position the load for attachment. Additional degrees of motion are needed between the ordnance device being loaded and the mounting hardware on an aircraft. Ideally the loading vehicle or dolly should also include means to provide these additional degrees of motion with ease and accuracy.

SUMMARY OF THE INVENTION

It is an object of this invention to provide an adapter means for use with the lift boom or fork-lift of a lift truck (or dolly) which will provide additional and finite fore or aft movement as well as lateral movement to the load, as necessary, to readily enable the ordnance load to be accurately positioned for attachment to an aircraft.

The device is an adapter for use on the lifting mechanism of a loading vehicle to readily and accurately position a load onto supporting apparatus, such as an aircraft. The device has a trolley means which provides fore/aft and lateral movement for imparting several degrees of freedom to the load to facilitate loading.

BRIEF DESCRIPTION OF THE PREFERRED EMBODIMENT

Figure 1:
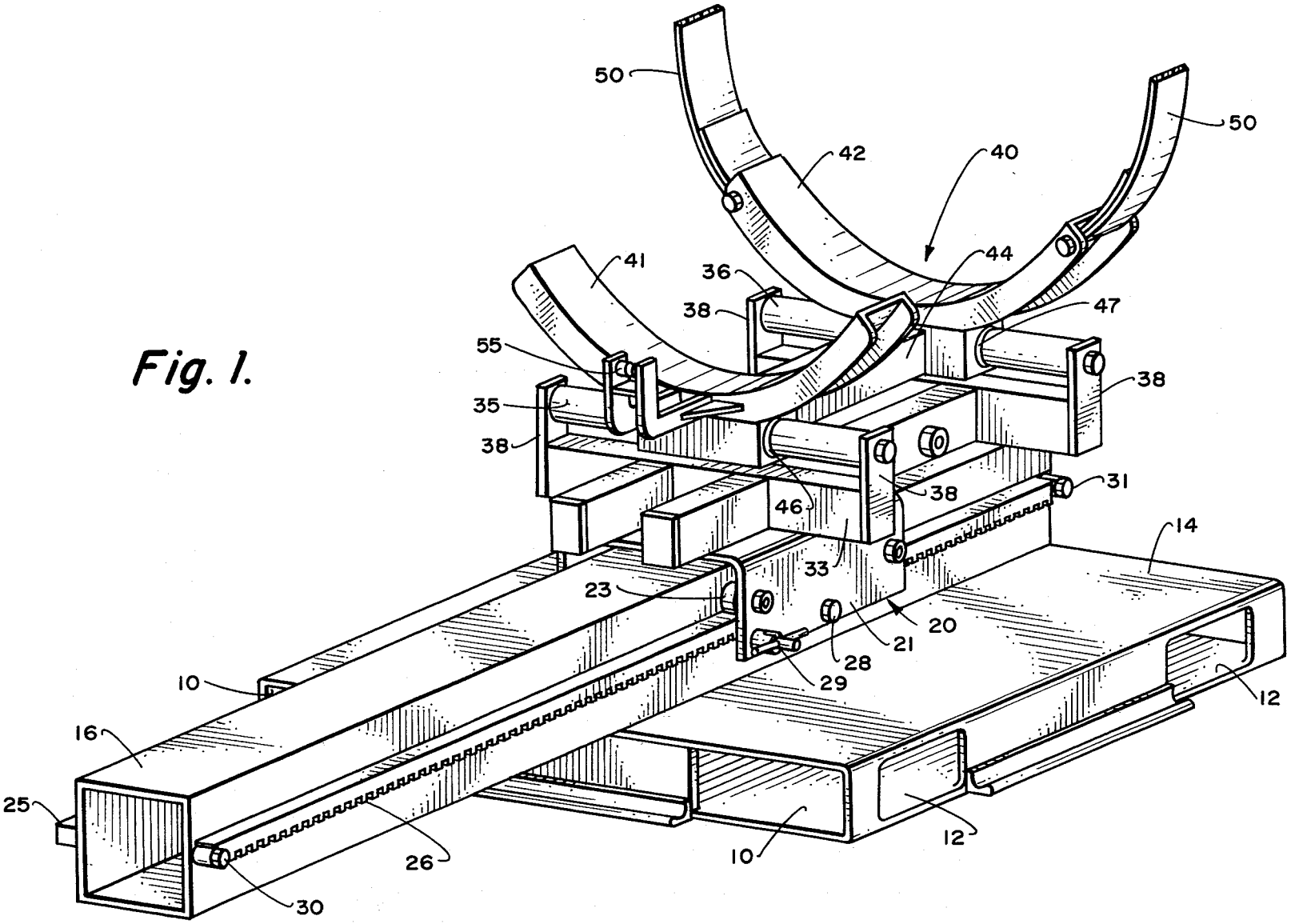
FIG. 1 is a perspective view of a preferred embodiment of the loading adapter of the invention.
Figure 2:
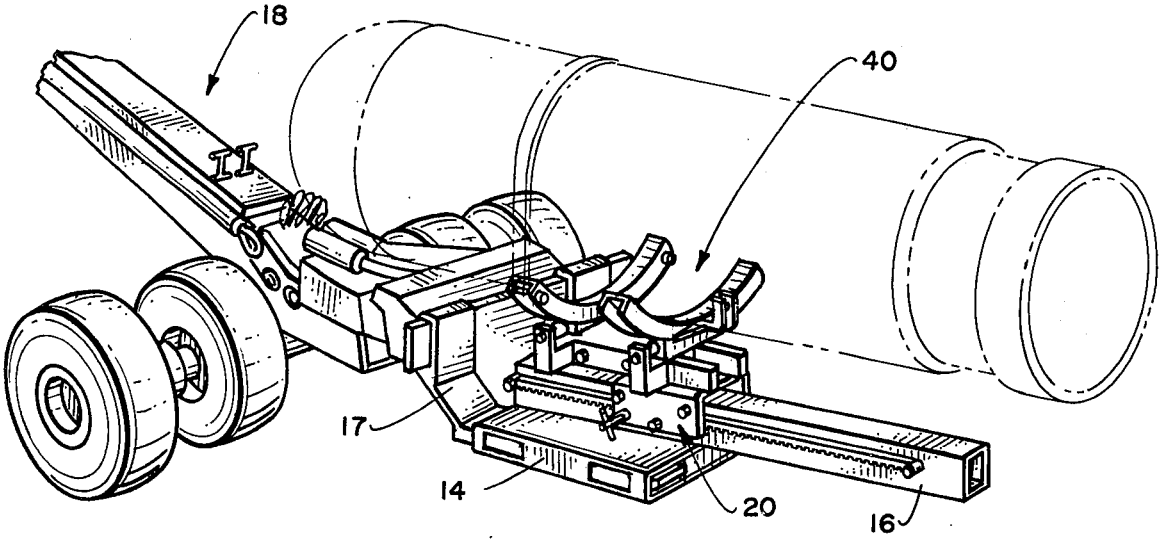
FIG. 2 is another perspective view showing the adapter secured to the lift forks of a loading vehicle.

The adapter, shown in FIG. 1, can be secured to the fork lift (or other lifting mechanism) of a loading vehicle, such as shown in FIG. 2 by way of example. Fork pockets 10 and 12, for example, are provided in the adapter base 14 either parallel (10) or perpendicular (12) to the main trolley beam 16. The forks 17 of the lift vehicle 18 slip into pockets 10 or 12 and the adapter readily lifted and moved about.

A trolley assembly 20 consists of a platform 21, having an inverted U-shaped cross-section which saddles the main trolly beam 16, and includes a plurality of cam-follower type bearings 23, for example, secured to both sides of the platform. Bearings 23 act as wheels which ride on the upper flat surface of a pair of parallel gear racks 25 and 26 (tracks) positioned on each side of trolley beam 16. As shown in FIGS. 1 and 2, trolly beam 16, is a single longitudinal beam which is saddled by platform 21. Trolley beam 16 is mounted on adapter base 14 and extends well beyond the edge of the base, as shown in the drawings, to provide a boom-like extension of substantially extended reach to the lift mechanism. Bolts 28 on each side of platform 21 prevent the platform from accidentally falling off the tracks, i.e., gear racks. Locking gear mechanisms 29, hereinafter described, are provided on either side of platform 21 and operate to engage with teeth on the underside of gear racks 25 and 26, respectively, to lock the platform in a desired position or during transportation. In addition, stops, such as bolts 30 and 31, can be provided at each end of trolley beam 16 to prevent the platform from riding off either end.

The trolley assembly 20 also includes a linear bearing rod framework 33 mounted on platform 21. A pair of parallel lateral bearing rods 35 and 36, respectively, are horizontally attached to framework 33 by brackets 38, such that the axial direction of the lateral bearing rods is at 90 degrees to the axial direction of the longitudinal trolley beam and gear racks.

Trolley beam 16 which extends well beyond the edge of adapter base 14 can be of any practical length; also, various length trolley assemblies can be used.

The saddle assembly 40, which cradles the load, consists of a fore saddle 41 and aft saddle 42 mounted on framework 44. Framework 44 includes two sets of linear bearings, 46 and 47, which operate to allow saddle framework 44 to slide laterally along lateral bearing rods 35 and 36, respectively. A locking means, not shown, can be provided to lock the cradle assembly 40 in a centered position on framework 33 during transportation, for example.

Straps, such as strap 50 shown on aft saddle 42, can be provided on either or both of saddles 41 and 42 for securely fastening a load to the device. Further, an attachment means 55 can be provided on one of the saddles to allow an ordnance load to be moved manually in a pitch movement during handling while securing the load from slipping in the saddles. The saddle assembly can be of various sizes and lengths to accommodate different types of loads.

Figure 3:
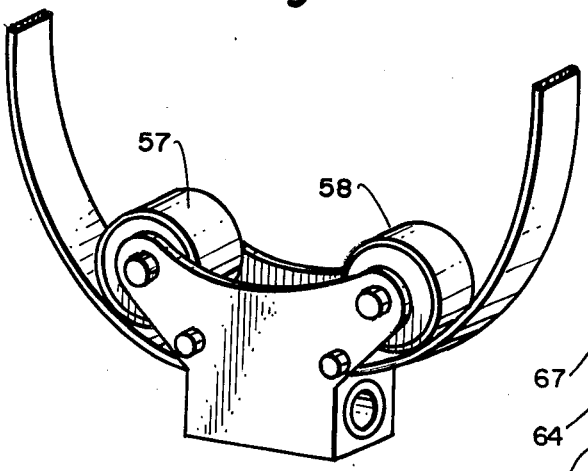
FIG. 3 shows another embodiment for the saddles in the device of FIG. 1.

Trolley assembly 20 is operable to be moved along trolley beam 16 to provide motion in the fore and aft directions while saddle assembly 40 is operable to be moved along lateral bearing rods 35 and 36 to provide motion in a lateral direction. Finite movements of the load carried in saddles 41 and 42, after the ordnance load carrying adapter is first moved into the general area for attachment to an aircraft by the boom of a lift truck or the like, allows the ordnance to be very accurately positioned in alignment with mounting hardware on the aircraft. Saddles 41 and 42 can also be provided with roller assemblies, such as shown in FIG. 3, for example, which include rollers 57 and 58 that permit rotation of a cylindrical ordnance load cradled in the saddles.

Figure 4:
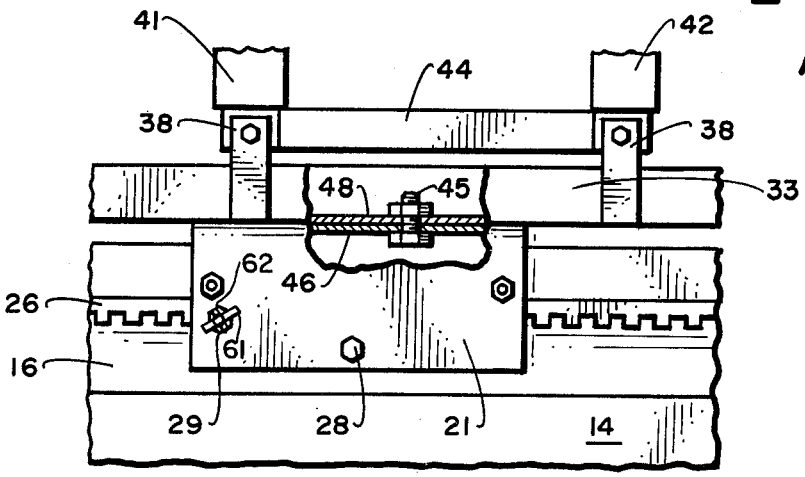
FIG. 4 shows a partial cutaway of a partial side view of the apparatus shown in FIG. 1.

In addition, linear bearing rod framework 33 can be swivelly mounted on platform 21 with a single bolt 45 or other swivel means, such as shown in FIG. 4 by way of example, for securely fastening the top 46 of platform 21 to the bottom plate 48 of framework 33. This will permit rotation of saddle assembly 40, in the horizontal plane, when framework 33 is rotated about bolt 45.

Figure 5:
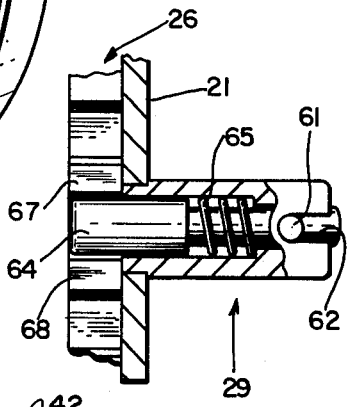
FIG. 5 shows a locking mechanism for use with the loading adapter.

Locking mechanism 20, on platform 21, can be a simple pin and spring mechanism, for example, as shown in FIGS. 4 and 5 which when actuated by turning handle 61 to slots 62 allows pin 64 to be extended by force of a spring 65 into spaces between two gear teeth, 67 and 68, on the bottom of gear rack 26. To unlock platform 21, pin 64 is retracted by pulling on handle 61 and rotating the handle about a one-quarter turn to the original position on locking mechanism 29 such as shown in FIG. 4.

Obviously many modifications and variations of the present invention are possible in the light of the above teachings. It is therefore to be understood that within the scope of the appended claims the invention may be practiced otherwise than as specifically described.

What is claimed is:

1. An ordnance loading adapter for use with the fork-lift mechanism of a lift fork-lift vehicle to permit ease in accurately positioning an ordnance load into alignment with mounting means on an aircraft for attachment thereto, comprising:

a. an adapter base means operable to be secured to the fork-lift mechanism of a fork-lift vehicle;

b. A longitudinal trolley beam mounted on said adaptor base means; said longitudinal trolley beam being of substantially greater length than said adapter base and providing a boom-like extension extending well beyond one edge of said adapter base to provide a substantially extended reach to the lift mechanism;

c. a pair of parallel track means mounted on both sides of said longitudinal trolley beam;

d. a trolley platform means of inverted U-shaped cross-section operable to saddle said longitudinal trolley beam and ride on said parallel track means;

e. a linear bearing rod support means mounted on said trolley platform means and having at least two parallel lateral bearing rods mounted thereon in an axial direction which is 90 degrees transverse to the axial direction of said longitudinal trolley beam and said track means;

f. a load support means adapted to hold an ordnance load; said support means slideably affixed to and operable to be moved and ride on said lateral bearing rods transversely to the axial direction of said longitudinal trolley beam to provide movement in a lateral direction;

g. said linear bearing rod support means also being swivelly mounted on said trolley platform means for rotation in the horizontal plane;

h. movement of said trolley platform along said track means being operable to provide fore or aft movement of said ordnance load while movement of said load support means on said lateral bearing rods being operable to simultaneously provide lateral movement of said ordnance load whereby accurate and finite positioning of said ordnance load to mounting means on an aircraft is permitted.

2. An ordnance loading adapter as in claim 1 wherein lock means is provided to lock said trolley platform means in a desired position along said track means.

3. An ordnance loading adapter as in claim 2 wherein said lock means includes gear teeth on said track means and locking gears on said trolley platform means.

4. An ordnance loading adapter as in claim 1 wherein said adapter base means is secured to the lift mechanism of said lift vehicle by means of fork pockets provided in said adapter base means; said fork pockets being provided both parallel and perpendicular to said trolley beam for alternate use.

5. An ordnance loading adapter as in claim 1 wherein said trolley platform means includes cam-follower type bearings which ride on said track means.

6. An ordnance loading adapter as in claim 1 wherein said load support means includes linear bearings which ride on said parallel lateral bearing rods.

7. An ordnance loading adapter as in claim 1 wherein load support means includes saddle means for cradling an ordnance load.

8. An ordnance loading adapter as in claim 1 wherein said load support means includes roller means to permit rotation of a cylindrical ordnance load about its cylindrical axis.

9. An ordnance loading adapter as in claim 1 wherein securing means is provided on said load support means to secure an ordnance load thereto.

10. An ordnance loading adapter as in claim 1 wherein means is provided to retain said trolley platform means on said trolley beam and track means.

* * * * *